United States Patent [19]

Burgin

[11] Patent Number: 4,797,515

[45] Date of Patent: Jan. 10, 1989

[54] SWITCH TIMING MECHANISM WITH SERRATED CAMSTACK

[75] Inventor: Henry E. Burgin, Greenwood, Ind.

[73] Assignee: Emhart Industries, Inc., Indianapolis, Ind.

[21] Appl. No.: 205,551

[22] Filed: Jun. 13, 1988

Related U.S. Application Data

[63] Continuation of Ser. No. 100,729, Sep. 25, 1987, abandoned.

[51] Int. Cl.[4] ..... H01H 43/10

[52] U.S. Cl. ..... 200/38 R; 200/38 B; 200/38 C

[58] Field of Search ..... 200/19 R, 27 R, 27 B, 200/38 R, 38 B, 38 BA, 38 C, 38 CA; 74/568 R, 568 T, 568 M

[56] References Cited

U.S. PATENT DOCUMENTS

| | | | |
|---|---|---|---|
| 3,699,278 | 10/1972 | Jones et al. | 200/38 R |
| 3,818,157 | 6/1974 | Voland et al. | 200/38 B |
| 3,862,384 | 1/1975 | Hrabovsky | 200/19 R |
| 4,381,433 | 4/1983 | Wagle | 200/38 C X |
| 4,484,040 | 11/1984 | Wagle | 200/38 R |
| 4,531,028 | 7/1985 | Stout et al. | 200/38 C X |
| 4,649,239 | 3/1987 | Duve | 200/38 R |

*Primary Examiner*—J. R. Scott

*Attorney, Agent, or Firm*—Carl A. Forest

[57] ABSTRACT

A plastic cylindrical camstack has different inside diameters. This leads to the problems of maintaining concentricity and elimination of excessive warpage during molding of the plastic. These problems have been substantially overcome by removing selected portions of the camstack in the area where the inside diameter is smaller, so that the net thickness of unbroken hub wall in this area is equal to the thickness of the hub wall in the areas where the diameter is larger. The material is removed to form serrations in the hub exterior surface, the serrations having a width slightly smaller than the length of a hub follower which rides on the hub surface.

6 Claims, 2 Drawing Sheets

SWITCH TIMING MECHANISM WITH SERRATED CAMSTACK

This application is a continuation of application Ser. No. 100,729, filed 9/25/87, now abandoned.

BACKGROUND OF THE INVENTION

The present invention relates to timing mechanisms and more particularly a to timing mechanism that includes a, cylindrical plastic camstack that has different inside diameters.

The present invention is particularly useful in timing mechanisms of the type shown and described in U.S. Pat. No. 4,381,433, "Drive Means For A Timing Mechanism", issued Apr. 26, 1983 to William E. Wagle. As described in that patent, a hollow cylindrical plastic camstack is provided with different major and minor diameters of ratchet teeth which provide a means to delay the actuation of switches which control the functions of an appliance such as a dishwasher.

Because of the different diameters, sections of the walls of the camstack will be thicker than other sections. This leads to the problems of maintaining concentricity of the camstack and elimination of excessive warpage during the molding of the hollow plastic cylinder. Such concentricity and elimination of excessive warpage are necessary to insure accurate timing of the switch actuation.

These problems become particularly acute when use is made of a switch blade arrangement of the type described in U.S. Pat. No. 4,531,028, "Timer With Improved Switch Blade Arrangement", issued July 23, 1985 to Garry A. Stout, et al. As described in that patent, there is provided a switch blade arrangement wherein there is at least one blade riding on the hub of the camstack such that the blade is referenced to the hub. This arrangement makes it even more mandatory that concentricity of the hub be as good as possible.

SUMMARY OF THE INVENTION

Accordingly there is provided a timing mechanism that includes a plastic camstack which substantially overcomes these problems which comprises: a hub having a first inside radius, at least one cam carried on the hub, the hub including an arc segment having a second smaller inside radius than the first inside radius, and a section of the hub having material removed therefrom along an arc length substantially equal to the length of the arc segment.

DETAILED DESCRIPTION OF THE INVENTION

Figure 1:
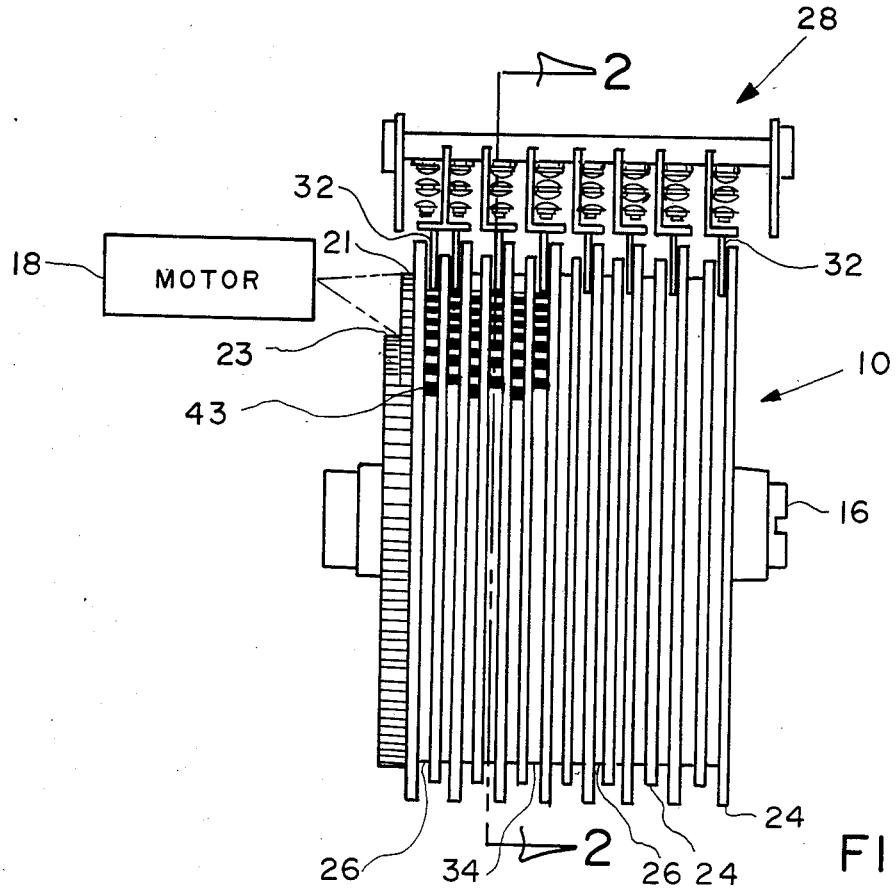
FIG. 1 is a side view of a camstack employing the invention.
Figure 2:
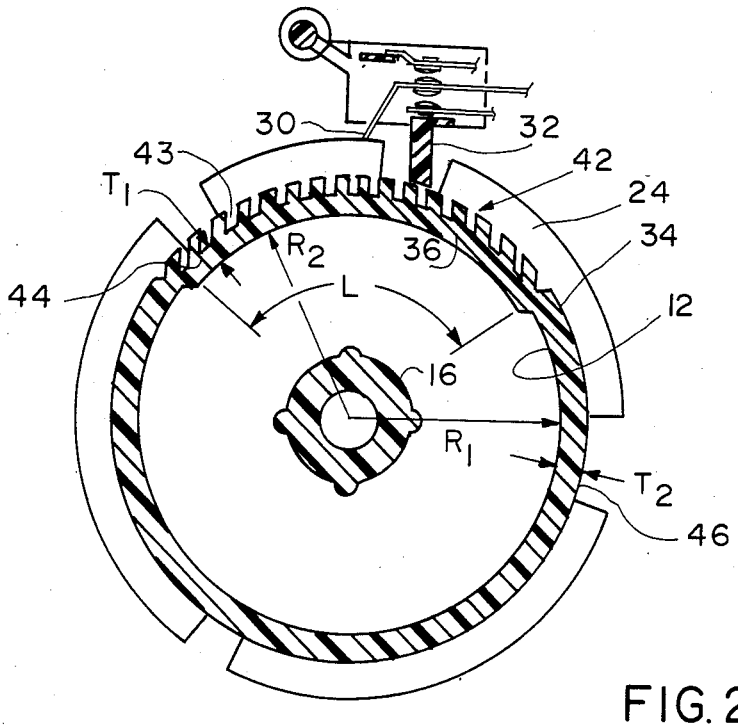
FIG. 2 is a section taken along the line 2—2 of FIG. 1.

Referring now to the drawings, there is shown a camstack 10 which employs this invention. The camstack is hollow having a hub 12 with a web (not shown) connected to a shaft 16. The camstack is coupled to a motor 18 through suitable coupling means (not shown) and ratchet teeth 21 and 23 in a manner completely described in the above noted U.S. Pat. No. 4,381,433. It is fabricated of a suitable plastic such as 20% glass filled modified polyhenylene oxide.

Carried on the outer surface of hub 12 are individual cam tracks 24, the cam tracks forming channel 26 therebetween. As described in the above noted U.S Pat. No. 4,531,028, a contact blade arrangement 28 has cam followers 30 riding on cam tracks 24 and hub followers 32 riding in channels 26 on the outer surface 34 of hub 12.

As described in the above-noted U.S. Pat. No. 4,381,433, ratchet teeth 21 and 23 have different major and minor diameters which cooperatively provide a means to delay actuation of switches of contact blade arrangement 28. The use of these different diameter teeth causes hub 12 to have different radii. Thus, as shown, hub 12 has an inside radius R1 and arc segment 36 having a radius R2; thus providing different wall thickness of the hub. As previously noted, such an arrangement causes difficulty in maintaining the hub's concentricity and excessive warpage in the hub during molding of the plastic.

According to the invention this has been substantially overcome by providing a section 42 of removed material from the hub. The removed section is provided along an arc length L that is substantially equal to the length of arc segment 36. In the embodiment shown, section 42 is provided through serrations 43 formed on surface 34 in channels 26. As shown the serrations are slightly smaller than the length of cam followers 32. They are of sufficient depth to provide a thickness $T_1$ of material 44 substantially equal to the thickness $T_2$ of the wall 46 of hub 12.

What is claimed:

1. A timing mechanism comprising:

a motor;

a camstack coupled to said motor, said camstack including: (a) a hub having an outer hub surface and an inner hub surface, said inner hub surface having a first inside radius and an arc segment of said inner surface having a second inside radius smaller than said first inside radius; and (b) cam means carried on said hub for providing a cam surface;

a switch comprising: (a) at least one switch blade; (b) referencing means for referencing said blade to said hub, said referencing means including a hub follower riding on said hub surface; and (c) a cam follower riding on said cam surface; and wherein a section of said hub directly underneath the area where said hub follower rides and above said arc segment has material removed therefrom.

2. A timing mechanism as in claim 1 wherein said section of said hub comprises a section of said hub surface having serration therein.

3. A timing mechanism according to claim 2 wherein said cam means comprises a plurality of individual cams carried on said hub surface providing channels therebetween and wherein said serrations are provided within at least one of said channels.

4. A timing mechanism according to claim 2 wherein said serrations are smaller in length than the length of said hub follower.

5. A timing mechanism according to claim 2 wherein the depth of said serrations is sufficient to leave a thickness of material in said arc segment substantially equal to the thickness of said hub in areas other than the area of said arc segment.

6. A timing mechanism as in claim 2 wherein said serrated section is along an arc length substantially equal to the length of said arc segment having a smaller radius.

* * * * *